US005505140A

United States Patent [19]

Wittmann

[11] Patent Number: 5,505,140

[45] Date of Patent: Apr. 9, 1996

[54] PALLET HAVING HIDDEN RAMPS

[75] Inventor: Glenn E. Wittmann, Downingtown, Pa.

[73] Assignee: Unisys Corporation, Blue Bell, Pa.

[21] Appl. No.: 299,862

[22] Filed: Sep. 1, 1994

[51] Int. Cl.[6] ..... B65D 19/00

[52] U.S. Cl. ..... 108/51.1; 108/55.1

[58] Field of Search ..... 108/51.1, 54.1, 108/52.1, 53.1, 55.1, 55.3, 55.5

[56] References Cited

U.S. PATENT DOCUMENTS

| | | | |
|---|---|---|---|
| 2,579,655 | 12/1951 | Donald | 108/55.1 X |
| 2,936,985 | 5/1960 | Doerr et al. . | |
| 3,511,393 | 5/1970 | Abromavage et al. . | |
| 3,620,388 | 11/1971 | Mansson . | |
| 3,971,314 | 7/1976 | Box | 108/51.1 X |
| 4,543,035 | 9/1985 | Lair | 108/52.1 X |
| 4,624,619 | 11/1986 | Uher . | |
| 4,911,084 | 3/1990 | Sato et al. | 108/55.3 X |
| 4,940,380 | 7/1990 | Ballyns et al. | 108/51.1 X |
| 5,170,721 | 12/1992 | Troth et al. . | |

FOREIGN PATENT DOCUMENTS

| | | | |
|---|---|---|---|
| 1107983 | 3/1968 | United Kingdom | 108/51.1 |
| 1262202 | 2/1972 | United Kingdom | 108/55.1 |

*Primary Examiner*—Jose V. Chen

*Attorney, Agent, or Firm*—Panitch Schwarze Jacobs & Nadel

[57] ABSTRACT

A pallet for the storage, transportation and unloading of equipment includes a support plate, a supporting structure, an opening and a movable ramp. The supporting structure extends from the support plate for supporting the support plate above a support surface. The supporting structure defines the opening which extends at least partially through the supporting structure. The movable ramp has a first end and a second end, and is movable between a storage position in which the first ramp is positioned within the opening while storing and transporting the equipment and a use position in which the ramp extends outwardly from the front edge of the support plate for unloading the equipment. The pallet may include, in place of the supporting structure, a plurality of spaced apart supporting members and a central member. The supporting members extend generally parallel to and are spaced from the plane of the support plate. The supporting members extend between the first and second side edges of the support plate. The central member is positioned between the support plate and the supporting members and extends between the front and back edges of the support plate.

11 Claims, 5 Drawing Sheets

82
84
86
88
86
88'
10
22
50

82
84
10
12
22
50

82
86
84
86
88
88'
10
22
50

94
86
92
82
86
90
10
78
80

PALLET HAVING HIDDEN RAMPS

FIELD OF THE INVENTION

The present invention relates to pallets for the storage and transportation of heavy equipment, and more particularly, the present invention relates to pallets having hidden ramps.

BACKGROUND OF THE INVENTION

Pallets, typically formed of wood, are used routinely in the storage, transportation and lifting of heavy equipment or cartons. The wooden pallets serve to support the bottom of the equipment or load to be lifted or moved while the equipment is stored in a warehouse or similar location or while the equipment is in transit from one location to another.

When the equipment is lifted, typically by a mechanism such as a hydraulic lift truck or "forklift," the pallet comes in contact with the forks of the lift truck preventing excessive damage to the equipment stored on the pallet. For extra safety, equipment may be fastened by ropes, bands or other similar connectors to a pallet to avoid the equipment falling while being lifted or moved.

Equipment is typically removed from a pallet by workers who either move the equipment by hand, or who attempt to maneuver the equipment onto a hand truck. Both of these methods require heavy lifting by the workers. Alternatively, the workers can attempt to use ramps which rest against the edge of the pallet to more easily remove the equipment from the pallet. Individual ramps are not always available at a job site when needed and are not typically sized to smoothly match up with the top surface of the pallet such that the equipment is not jostled in some manner. Smooth removal of heavy equipment absent significant vibration is particularly important in the transportation and unloading of heavy, sensitive electronic equipment and office machinery such as computers, copy machines, laser printers and the like.

To make ramps more convenient, there have been prior art attempts to make a pallet having removable or retractable ramps which can be extended only when needed. One such attempt is disclosed in U.S. Pat. No. 4,911,084 in which a pallet is made which includes removable ramps that are stored on the top of the pallet below the equipment being transported during transit. To unload, the heavy equipment must be still be manually lifted to remove supporting planks beneath the equipment and to slide out the ramps. The use of this pallet still requires heavy lifting from the workers. In addition, the storage of the heavy equipment on top of the ramps renders the ramps more easily subjected to damage from the weight of the equipment and/or accidents occurring during transit or storage of the pallet and equipment.

U.S. Pat. No. 2,936,985 discloses a pallet which has hinged side ramps that pivot down for unloading of equipment stored on the pallet. In transit, the ramps are folded up against the side of the equipment. These ramp sections are still vulnerable to damage during transit and storage. In addition, the ramps, which may rest against the equipment, are capable of subjecting portions of sensitive equipment contacting the folding ramps to damage and/or vibration. As the pallet may, in many cases, be larger than the equipment loaded on the pallet, the ramps when folded upwardly may extend outward from the equipment presenting a potential for injury to workers passing by and/or handling the equipment.

Therefore, a need exists in the art for an economical pallet which adequately supports equipment particularly heavy, sensitive equipment, during storage and while in transit, and which includes convenient, hidden ramps within the pallet that are protected from damage during storage, transit and lifting operations and which are removable to provide a smooth surface in conjunction with the pallet for unloading of equipment with minimal vibration and/or manual lifting.

SUMMARY OF THE INVENTION

The pallet of the present invention includes one or more hidden ramps which are safely positioned inside openings in the pallet during storage and transportation of equipment. The ramps and pallet are designed such that equipment may be strapped to the pallet during storage and transportation without the strapping damaging the hidden ramps. To unload the equipment, the strapping is severed and the ramps are easily removed from the pallet. The ramps are placed against a supporting structure of the pallet such that they extend from and smoothly and evenly contact the pallet. The ramps are adequately supported while in the extended position to avoid unnecessary stress due to the weight of the equipment and to provide an easy, smooth unloading of the equipment with minimal vibration.

The ramps and strapping interact to hold the equipment to the pallet and to hold the ramps securely within the pallet during storage and while the pallet and equipment are in transit. In addition, the pallet and ramps are designed to minimize vibration and damage to sensitive equipment during storage, transportation and unloading of the equipment from the pallet. The pallet is also designed to avoid damage to the hidden ramps or the equipment strapped to the pallet from use of a forklift or similar hydraulic lifting device.

The invention includes a pallet for the storage, transportation and unloading of equipment. The pallet includes a support plate which lies in a plane and has front, back, first and second side edges. The pallet also includes a plurality of spaced apart supporting members and a central member. The supporting members, which extend between the first and second side edges of the support plate, are spaced apart from one another and are generally parallel to and spaced from the plane of the support plate. The central member is positioned between the support plate and supporting members, and extends between the front and back edges of the support plate.

Together, the support plate, supporting members and central member define a first opening which extends at least partially through the pallet. In addition, the pallet includes a first movable ramp having a first end and a second end. The ramp is movable between a storage position and a use position. In the storage position, the ramp is located within the first opening while storing and transporting the equipment. In the use position, the ramp extends outwardly from the front edge of the support plate for unloading the equipment.

The invention also comprises a pallet which includes a support plate and a movable ramp, as described above, and a supporting structure. The supporting structure extends from the support plate to support the plate above a support surface, and defines an opening which extends at least partially through the supporting structure.

BRIEF DESCRIPTION OF THE DRAWINGS

The foregoing summary, as well as the following detailed description of preferred embodiments of the invention, will be better understood when read in conjunction with the appended drawings. In the drawings, like numerals are used to indicate like elements throughout. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENTS

Figure 1:
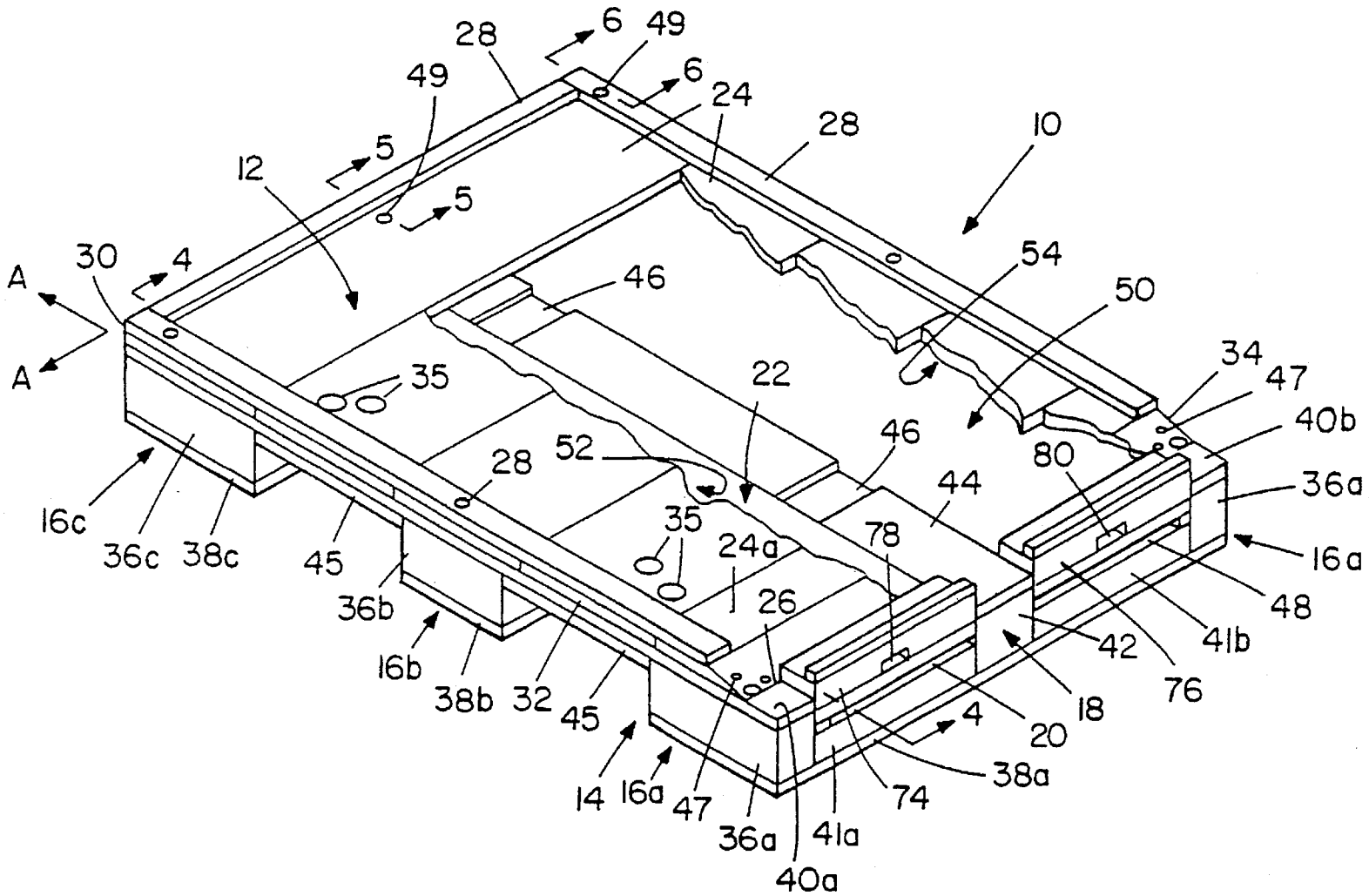
FIG. 1 is a perspective view, partially broken away, of a pallet in accordance with a preferred embodiment of the present invention in which the ramps are in a storage position.

Certain terminology is used in the following description for convenience only and is not limiting. The words "top," "bottom," "front," and "back" designate directions in orientation of FIGS. 1 to 11 of the drawings to which reference is made. The words "inwardly" and "outwardly" refer to directions toward and away from, respectively, for example, the geometric center of the pallet and parts thereof. The terminology includes the words above specifically mentioned, derivatives thereof, and words of similar import.

Referring now to the drawings in detail, there is shown in FIGS. 1–11, a preferred embodiment of a pallet, generally designated as 10, according to the present invention. The pallet 10 includes a support plate 12 and a supporting structure 14. The structure 14 includes supporting members 16 and a central member 18. The support plate 12, supporting members 16 and central member 18 define an opening 20. The pallet also includes a first movable ramp 22. The following description is written to provide an exemplary configuration for a pallet 10 made in accordance with a preferred embodiment of the present invention in order to clearly describe the pallet 10. Such an exemplary pallet 10 is about 2.7 feet in width as measured transversely across the top of the pallet 10, 3.7 feet in length as measured longitudinally across the bottom of the pallet 10 and 6.5 inches in height as measured transversely from the top to the bottom of the pallet 10. However, it should be understood, from this disclosure, that other sizes and configurations of the pallet 10 are within the scope of this invention and any dimensions and/or specific materials of construction are in no way limiting in nature.

Figure 2:
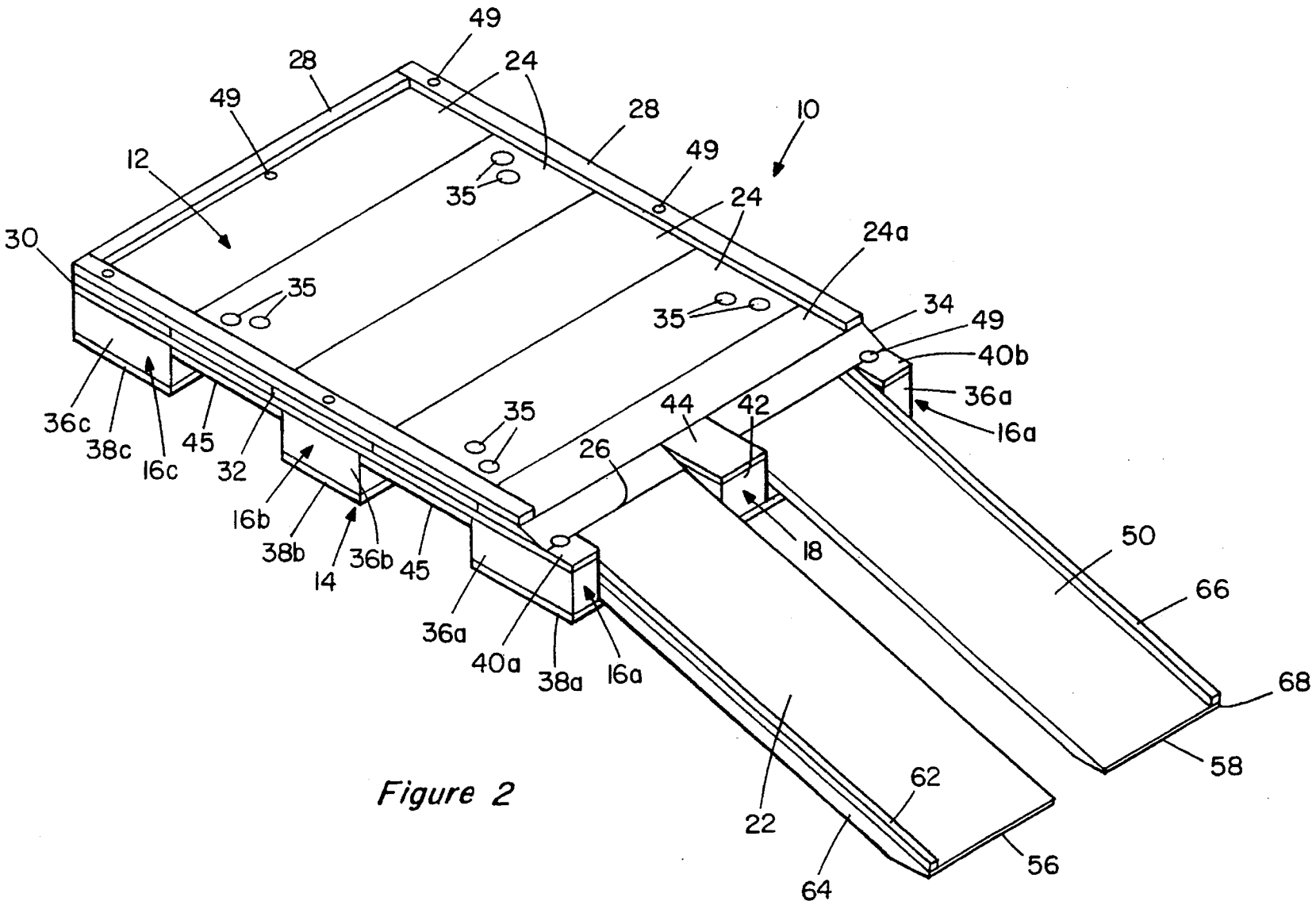
FIGS. 2 is a perspective view of the pallet of FIG. 1 with the ramps in a use position.

As best shown in FIGS. 1 and 2, the support plate 12 of the pallet 10 may be one solid flat planar surface, preferably formed of wood or a similar material which lies in a plane A as shown in FIG. 1. More preferably, the support plate 12 is made up of a plurality of contiguous boards 24 which run transversely across the pallet 10. Preferably, the contiguous board **24*a* which is positioned along the front edge 26 of the support plate 12 is partially inclined such that when the ramp 22 is in the use position, i.e. extended, as shown in FIG. 2, the inclined board 24*a* and ramp 22 provide a generally smooth surface for removal of equipment. Preferably, the boards 24 are each about 0.75 inch thick, about 9.25 inches wide and about 32 inches long, with the exception of the board 24*a* which is positioned along the front edge 26 of the support plate 12. Preferably that board 24*a* is slightly less wide than the other boards 24 to facilitate removal and storage of the ramp 22. A preferred width for the board 24*a* is about 6.75 inches wide. If an inclined board 24*a* is provided, the inclined portion of the board 24*a*** is preferably about 2.4 inches wide.

Runners 28 are preferably provided along the back edge 30, the first side edge 32 and the second side edge 34 of the support plate 12 as shown in FIGS. 1 and 2. The runners 28 help to keep equipment loaded on the pallet 10 from sliding off of the pallet 10 when not securely strapped, for example, during the loading or unloading of equipment from the pallet 10. If an inclined board **24*a* is provided along the front edge 26 of the support plate 12, the runners 28 extending along the side edges 32, 34 of the support plate 12 preferably do not extend along the inclined portion of the board 24*a*. The runners 28 may be of any thickness or width sufficient to prevent equipment on the pallet 10 from rolling off of the edges 30, 32, 34 of the support plate 12. In the exemplary pallet 10** as described, the runners are preferably about 0.75 inch thick and about 1.5 inches wide.

Preferably, the support plate 12 includes at least two, and preferably more than two, strapping holes 35 as shown in FIGS. 1 and 2. Preferably, the holes 35 extend through the support plate 12 in a direction perpendicular to plane A of the support plate 12. It is preferred that the holes 35 be positioned proximate to the side edges 32, 34 of the support plate 12, but within the runners 28 as shown in FIGS. 1 and 2, and that the holes 35 are approximately longitudinally and transversely aligned with each other.

The supporting structure 14 of the pallet 10 extends from the support plate 12 for supporting the plate 12 above a support surface (not shown). The structure 14 includes a plurality of spaced apart supporting members 16 and a central member 18. Preferably, there are three supporting members **16*a*, 16*b* and 16*c* as shown in FIGS. 1 and 2 which are generally parallel to and spaced from the plane A. The supporting members 16*a*, 16b and 16c each include a pair of outer support blocks 36*a*, 36*b*, 36*c*. Each block 36 in the pair 36*a*, 36*b*, 36*c* is preferably positioned adjacent one of the side edges 32, 34 of the support plate 12. The supporting members 16*a*, 16*b*, 16*c* preferably also include boards 38*a*, 38*b*, 38*c* which each extend transversely across the pallet 10 preferably interconnecting each pair of blocks 36*a*, 36*b*, 36*c* such that the supporting members 16*a*, 16*b*, 16*c* extend between the first and second side edges 32, 34 of the support plate 12. The blocks 36 are preferably formed of a compressible substance which has the capacity to absorb vibration such as, for example, an open or closed cell foam. A suitable commercially available foam which may be used for the blocks 36 is Ethafoam® from Dow Chemical having a 4 pound density. For the purposes of the exemplary pallet 10, the blocks 36 each preferably measure about 3.5 inches in height, about 2.5 inches in width as measured transversely along the pallet 10, and about 9.25 inches in length as measured longitudinally along the pallet 10. The boards 38** extending along the bottom of the blocks 36 are preferably of the same dimensions as the boards 24.

Preferably, all of the blocks 36 along one of the side edges 32, 34 are interconnected longitudinally by a thin board 40 as shown in FIGS. 1 and 2. The blocks 36*a*, 36*b*, 36*c* adjacent the first side surface 32 of the support plate 12 are preferably interconnected by a thin board 40*a* and the blocks 36*a*, 36*b*, 36*c* adjacent the second side surface 34 of the support plate 12 are preferably interconnected by a thin board 40*b*. The boards 40*a*, 40*b* are preferably of a sufficient width and thickness to allow for interconnection of the runners 28, the support plate 12 and the supporting members 16 in the pallet 10 by various screws, bolts and the like, but thin enough not to extend into the area of the pallet 10 for ramp 22 storage. In the exemplary pallet 10, the boards 40*a*, 40*b* are preferably about 2.5 inches wide, about 0.75 inches thick and extend longitudinally along the entire length of the pallet 10.

Preferably, the supporting members 16 of the supporting structure 14 also include a first ramp supporting block 41*a* and a second ramp supporting block 41*b*. The first ramp supporting block 41*a* is positioned proximate the first opening 20 adjacent the front edge 26 of the support plate 12. The second ramp supporting block 41*b* is positioned proximate the second opening 48 adjacent the front edge 26 of the support plate 12. The ramp supporting blocks 41 are preferably fixed to the board 38*a* of the supporting member 16 adjacent the front edge 26 of the support plate 12 and are preferably nonmovable. Each ramp supporting block 41*a*, 41*b* preferably extends transversely between one of the support blocks 36*a* and the central member 18 such that each ramp supporting block 41*a*, 41*b* extends fully across its corresponding opening 20, 48.

Figure 4:
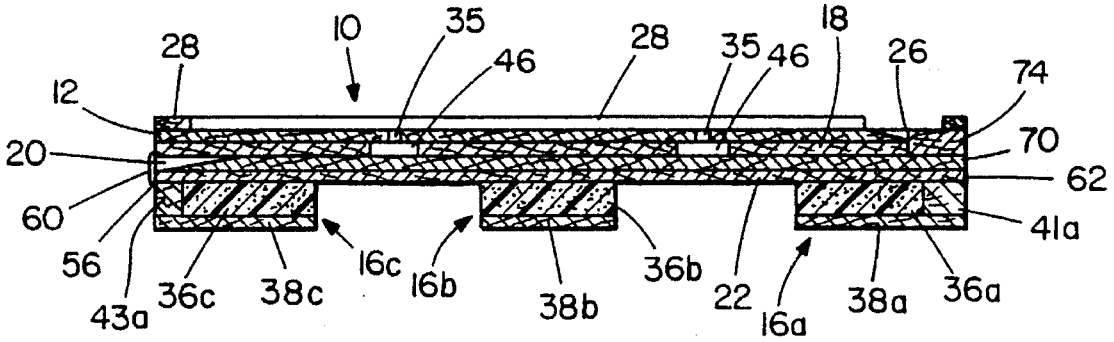
FIG. 4 is a cross-sectional view taken along line 4—4 of FIG. 1.
Figure 7:
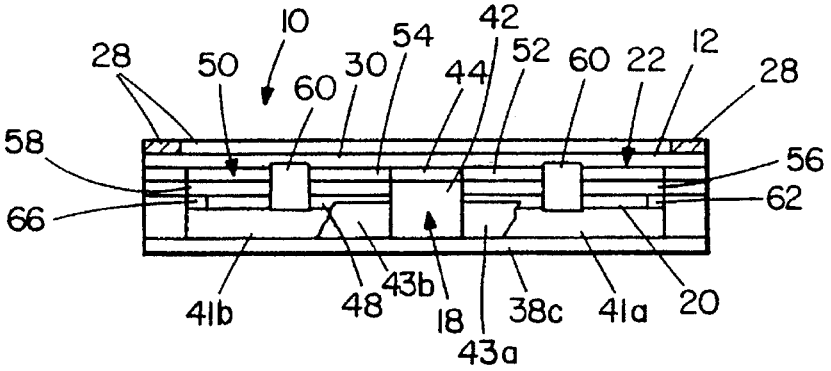
FIG. 7 is a rear elevational view of the pallet of FIG. 1.

The supporting structure 14 preferably also includes two boards 43*a*, 43*b* which each extend transversely across the pallet 10 adjacent to but spaced from the back edge 30 of the support plate 12 in a plane generally perpendicular to plane A of the support plate 12. The boards 43*a*, 43*b* are each preferably positioned such that they are also perpendicular to the board 38*c*. The boards 43*a*, 43*b* are preferably sized such that they at least partially cover the back of the pallet 10 and such that they rest on top of board 38*c* as shown in FIGS. 4 and 7. The boards 43*a*, 43*b* in FIG. 7 are partially broken away to reveal the rear view of the pallet 10.

The supporting structure 14 preferably further includes thin boards 45 extending between the spaced apart supporting members 16 adjacent the first and second side edges 32, 34 of the support plate 12. The boards 45 extend longitudinally between the supporting members 16 and are preferably of the same width and thickness as the thin boards 40*a*, 40*b* such that neither the thin boards 40*a*, 40*b* nor the boards 45 extend into the area for ramp 22 storage.

The central member 18 of the supporting structure 14 preferably comprises a plurality of support blocks 42. The blocks 42 are preferably formed of the same compressible material as the blocks 36. Preferably there are three blocks 42 positioned such that they are transversely and longitudinally aligned with the blocks 36 in the supporting structure 14 and are positioned transversely between the support plate 12 and the supporting members 16. The blocks 42 are interconnected transversely along the bottom of the pallet 10 with the blocks 36 by the boards 38. The blocks 42 are interconnected longitudinally along the top by a board 44 which runs parallel to the plane A and adjacent the support plate 12. The board 44 in the exemplary pallet 10 is preferably about 4.0 inches wide and about 0.75 inches thick. The central member 18 preferably extends along the full length of the pallet 10 at least from the front edge 26 to the back edge 30 of the support plate 12. The board 44 preferably comprises a plurality of recessed grooves 46 to facilitate transverse strapping for equipment stored on the pallet 10. The grooves 46 are preferably transversely aligned with the strapping holes 35.

The opening 20, defined by the supporting structure 14, particularly the support plate 12, the supporting members 16 and the central member 18, extends at least partially through the pallet 10. Preferably, the opening 20 extends the full length of the pallet 10. Most preferably, there is a second opening 48 adjacent the first opening 20, also defined by the supporting structure 14, particularly the support plate 12, the supporting members 16 and the central member 18. It is also preferred that the first opening 20 is positioned between the supporting members 16 adjacent the first side edge 32 of the support plate 12 and the central member 18, and the second opening 48 is positioned between the supporting members 16 adjacent the second side edge 34 of the support plate 12 and the central member as shown in FIGS. 1 and 7. Preferably, both openings 20, 48 extend the entire length of the pallet 10.

Figure 5:
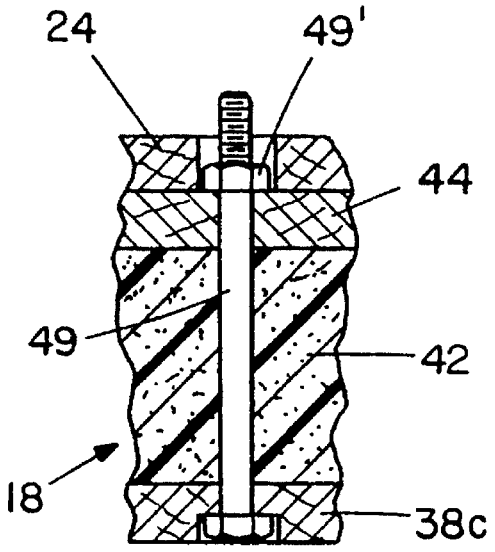
FIG. 5 is a cross-sectional view taken along line 5—5 of FIG. 1.
Figure 6:
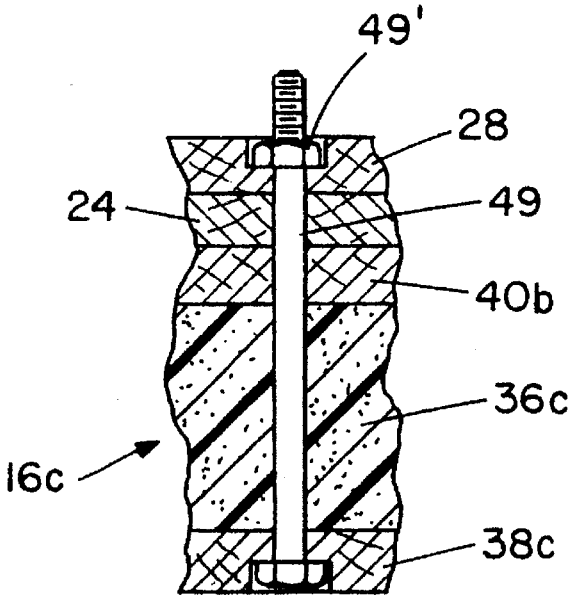
FIG. 6 is a cross-sectional view taken along line 6—6 of FIG. 1.

The supporting structure 14 and the support plate 12 are preferably held together by one or more suitable fasteners. Preferably, a series of screws and bolts fasten the structure 14 to the plate 12. It is preferred that wood screws 47 are placed in various locations as shown in FIGS. 1 and 2. In addition, hex head bolts 49 passing through the pallet 10 in a direction generally perpendicular to plane A are preferably used to fasten the layers of boards together along the front, back and side edges 26, 30, 32, 34 of the support plate 12. As shown in FIGS. 5 and 6, the bolts 49 are passed through the various layers and are secured by washers and lock nuts 49'.

Preferably the pallet 10 includes two movable ramps, a first ramp 22 and a second ramp 50. Each ramp is movable between a storage position as shown in FIGS. 1, 4 and 7 and a use position as shown in FIG. 2. In the storage position, the first ramp 22 is positioned within the first opening 20 and preferably, the second ramp 50 is positioned within the second opening 48 for storage and transportation of the equipment. In the use position, the first ramp 22 and, preferably, the second ramp 50, extend outwardly from the front edge 26 of the support plate 12 for unloading of the equipment.

Preferably, in the storage position, the ramps 22, 50 are suspended within the openings 20, 48 respectively such that a first access space 52 is created between the support plate 12 and the first ramp 22 and a second access space 54 is created between the support plate 12 and the second ramp 50. The ramps 22, 50 may be suspended within the openings 20, 48 by any suitable means.

Preferably, the ramps 22, 50 are suspended on their first ends 56, 58 by means of brackets or clips 60 fastened to the back edge 30 of the support plate 12 and depending at least partially into the openings 20, 48 as shown in FIGS. 4 and 7. While brackets 60 are shown in the drawings, it should be understood, based upon this disclosure, that any similar structure such as a hook, an L-shaped board, an upwardly extending peg and the like may be used to suspend the first end 56 of the first ramp 22 and the first end 58 of the second ramp 50 in the openings 20, 48.

Figure 3:
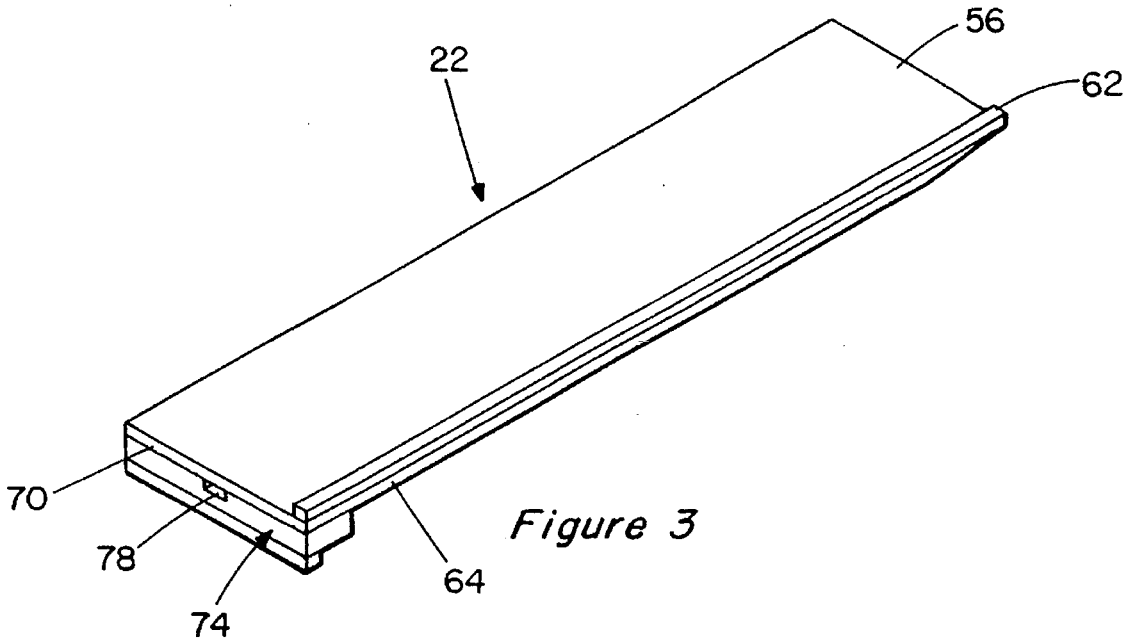
FIG. 3 is a perspective view of a ramp used in the pallet of the present invention.

The first ramp 22 preferably includes a runner 62 which extends longitudinally along the outside edge 64 of the first ramp 22 when the ramp 22 is in the use position as best shown in FIGS. 2 and 3. In the same manner, the second ramp 50 preferably includes a runner 66 which extends longitudinally along the outside edge 68 of the second ramp 50 when the ramp 50 is in the use position. The runners 62, 66 help to prevent equipment being unloaded from the pallet 10 from slipping off of the ramps 22, 50 when the ramps 22, 50 are in the use position. In the storage position, as best shown in FIGS. 1, 4 and 7, when the ramps 22, 50 are preferably suspended within the openings 20, 48, the second end 70 of the first ramp 22 rests on its runner 62 along the first ramp supporting block 41*a*. Similarly, the second end 72 of the second ramp 50 rests on its runner 66 along the second ramp supporting block 4lb. The runners 62, 66 may, therefore, also function to help suspend the ramps 22, 50 in the openings 20, 48.

Preferably, the first ends 56, 58 of the ramps 22, 50 are inclined or beveled such that when the ramps 22, 50 are in the use position as shown in FIG. 2, the ramps are smoothly and firmly in contact with a support surface (not shown) such as the ground or a warehouse floor.

Preferably, the first ramp 22 also includes a protruding portion 74, preferably in the form of an L-shaped block, along its second end 70. Similarly, it is preferred that the second ramp 50 includes a protruding portion 76, preferably also in the form of an L-shaped block, along its second end 72 as shown in FIGS. 1 and 3. When the ramps 22, 50 are in the use position, the ramps 22, 50 are removed from the openings 22, 48 and inverted such that the protruding portions 74, 76 are located beneath the ramps 22, 50 and the first and second protruding portions 74, 76 preferably rest against the first and second ramp supporting blocks 41*a*, 41*b* respectively. The protruding portions 74, 76 preferably function to stabilize the ramps 22, 50 in the use position such that vibration is minimized during unloading of equipment and such that the ramps 22, 50 do not slip out of position under the weight of the equipment. In addition, the protruding portions 74, 76 are preferably configured in an L-shape such that they firmly hold the ramps 22, 50 against the ramp supporting blocks 41*a*, 41*b* during unloading.

By suspending the ramps 22, 50 as described, side entry of a lift device such as a forklift will not damage the ramps 22, 50. The fork or lift portion of the device will lift the pallet by resting the boards 45 on the forks or lift portion of the device, but will not contact the suspended ramps 22, 50.

It is preferred that a strapping hole 78 extend longitudinally through the protruding portion 74 of the first ramp 22, and a strapping hole 80 extend longitudinally through the protruding portion 76 of the second ramp 50. In storing and transporting equipment, particularly sensitive electronic equipment, it is preferred that the pallet 10 further include a system of strapping and packaging which functions to securely hold the equipment to the pallet 10, to secure the ramps 22, 50 in place without damaging the ramps 22, 50 and to help to minimize vibration and movement of the equipment when being transported on the pallet 10.

Figures 8, 9, 10, 11:
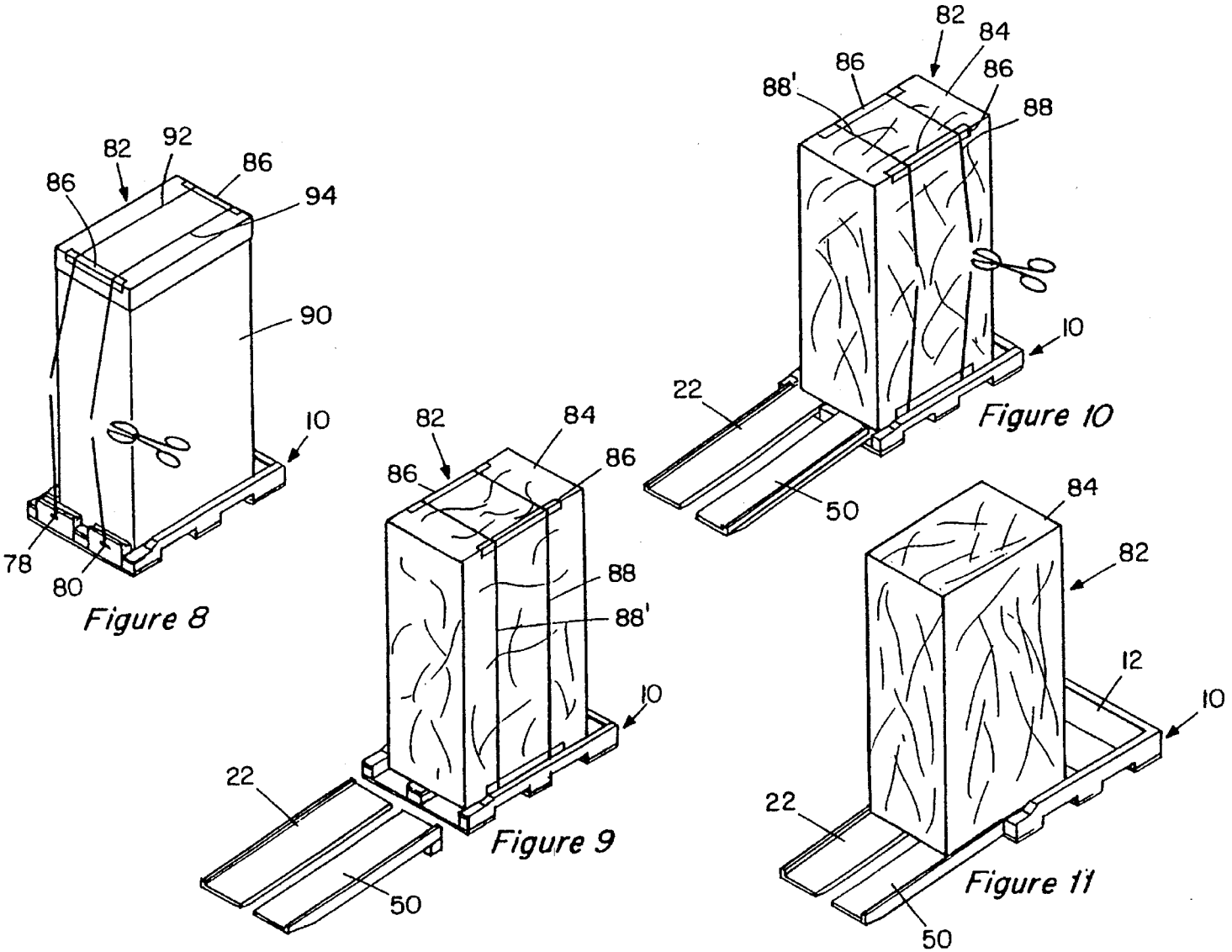
FIGS. 8 to 11 together are a schematic representation of consecutive steps of a method for unloading equipment stored on a pallet in accordance with the preferred embodiment of the present invention.

FIGS. 8–11 schematically illustrate a preferred strapping and packaging system as well as the preferred method for unloading equipment from the pallet 10. Preferably, the equipment 82 is packaged in two layers. The first layer of packaging 84 which surrounds the equipment 82 is a protective layer which may be any made of any suitable packing material, including, for example, foam, bubble wrap, cardboard, paper and the like which may or may not have a further protective layer beneath the packing. Preferably protective edge pieces 86, made of any suitable material such as, for example, plastic strip, are placed along top edges of the equipment to protect the equipment from the strapping 88. A first piece of strapping 88 is positioned over the first layer of packaging 84 on the equipment 82 in a transverse direction. The strapping may be any suitable strapping material including, for example, rope, twine, woven synthetic fabric strapping, plastic strips, metal chain or similar materials. The strapping 88 is passed downwardly through a strapping hole 35 adjacent the first side 32 of the support plate 12. The strapping 88 is then passed through the first access space 52 and through one of the recessed grooves 46 transversely aligned with the strapping hole 35 through which the strapping 88 was initially passed. From the recessed groove 46, the strapping 88 is passed through the second access space 54 and outwardly through a further strapping hole 35 as shown in FIGS. 9 and 10. If more than one set of strapping holes 35 are provided than further strapping 88' may be extended transversely across the equipment 82 for additional stability.

Once the transverse strapping 88, 88' is in place, a further layer of packaging 90 is preferably provided to the equipment 82 as shown in FIG. 8. The packaging 90 may be any suitable durable exterior packing such as, for example, a corrugated carton. It is also preferred that the packaging 90 be easily removable from the equipment 82 without lifting the equipment 82. This may be accomplished by providing either breakaway packaging having easily removable side surfaces and/or an open-bottom carton. A second piece of strapping 92 is passed longitudinally over the equipment packaging 90 on the equipment 82. The strapping 92 passes inwardly through the strapping hole 78 in the first ramp 22 and through the first access space 52. The strapping 92 then passes longitudinally through the access space 52 and out of the pallet 10 adjacent the back edge 30 of the support plate 12. Similarly, a third piece of strapping 94 is passed over the equipment 82 and inwardly through the strapping hole 80 in the second ramp 50. The strapping 94 then passes longitudinally through the access space 54 and out of the pallet 10 adjacent the back edge 30 of the support plate 12. Further edge protectors 86 may be provided on the packaging 90 to protect the equipment 82 as shown in FIG. 8.

The arrangement for packaging and strapping as described allows the strapping 88, 88', 92, 94 to pass securely over the equipment 82 and through the pallet 10 without pressing against the thinner, more vulnerable portions of the ramps 22, 50 by passing the strapping 88, 88', 92, 94 only through the access spaces 52, 54. The ramps 22, 50 are further securely suspended and stored in the openings 20, 48 by passing the strapping through the stronger protruding portions 74, 76 of the ramps 22, 50.

When the equipment 82 is to be unloaded, the longitudinal strapping 92, 94 on the external packaging 90 is severed or unhooked depending upon the strapping 92, 94 used as shown in FIG. 8. The outer packaging 90 and severed strapping 92, 94 are then removed such that the ramps 22, 50 are free to be removed from the openings 20, 48. The ramps 22, 50 are removed from the openings 20, 48 in the pallet 10 and inverted. The protruding portions 74, 76 of the ramps 22, 50 are then placed in position over the ramp supporting blocks 41*a*, 41*b* such that the inclined second ends 70, 72 of the ramps 22, 50 are resting against the support surface onto which the equipment is to be unloaded as shown in FIGS. 9 and 10. Once the ramps 22, 50 are in place, the transverse strapping 88, 88' is severed and removed as shown in FIG. 10. The protective packaging 84 is preferably left on the equipment 82 to protect it during transportation. The equipment 82 is then free to be safely and smoothly moved down the ramps 22, 50 as shown in FIG. 11.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A pallet for the storage, transportation and unloading of equipment, comprising:

(a) a support plate lying in a plane and having a front edge, a back edge, a first side edge and a second side edge;

(b) a plurality of spaced apart supporting members extending generally parallel to and being spaced from the plane of the support plate, the supporting members extending between the first and second side edges of the support plate;

(c) a central member positioned between the support plate and the supporting members and extending between the front and back edges of the support plate;

(d) a first opening defined by the support plate, the supporting members and the central member, the opening being between the plane of the support plate and the supporting members and extending at least partially through the pallet between the front and back edges of the support plate; and (e) a first movable ramp having a first end and a second end, the first ramp being movable between a storage position wherein the first ramp is positioned within the first opening while storing and transporting the equipment and a use position wherein the first ramp extends outwardly from the front edge of the support plate for unloading the equipment.

2. The pallet according to claim 1, wherein the front edge of the support plate is inclined to facilitate unloading the equipment.

3. The pallet according to claim 1, wherein pallet further comprises a second opening defined by the supporting members, the central member and the support plate, the second opening adjacent the first opening, and a second movable ramp having a first end and a second end, the second ramp being movable between a storage position wherein the second ramp is positioned within the second opening while storing and transporting the equipment and a use position wherein the second ramp extends outwardly from the front edge of the support plate for unloading the equipment.

4. The pallet according to claim 3, wherein the pallet further comprises means for suspending the first ramp within the first opening, the first ramp suspending means connected to the support plate and creating a first access space between the first ramp and the support plate and means for suspending the second ramp within the second opening, the second ramp suspending means connected to the support plate and creating a second access space between the second ramp and the support plate.

5. A pallet for the storage, transportation and unloading of equipment, comprising:

(a) a support plate lying in a plane and having a front edge, a back edge, a first side edge and a second side edge;

(b) a plurality of spaced apart supporting members extending generally parallel to and being spaced from the plane of the support plate, the supporting members extending between the first and second side edges of the support plate and comprising a first and a second ramp supporting block, the first ramp supporting block being positioned adjacent the front edge of the support plate and the second ramp supporting block being positioned adjacent the front edge of the support plate;

(c) a central member positioned between the support plate and the supporting members and extending between the front and back edges of the support plate;

(d) a first opening defined by the support plate, the supporting members and the central member, the opening proximate the first ramp supporting block and extending at least partially through the pallet;

(e) a second opening defined by the support plate, the supporting members and the central member, the second opening adjacent the first opening and proximate the second ramp supporting block;

(e) a first movable ramp having a first end and a second end;

(f) a second movable ramp having a first end and a second end; and (g) means for suspending the first ramp within the first opening, the first ramp suspending means connected to the support plate and creating a first access space between the first ramp and the support plate and means for suspending the second ramp within the second opening, the second ramp supporting means connected to the support plate and creating a second access space between the second ramp and the support plate, the first ramp and the second ramp being movable between a storage position wherein the first and second ramps are positioned within the first and second openings respectively while storing and transporting the equipment and a use position wherein the first and second ramps extend outwardly from the front edge of the support plate for unloading the equipment.

6. The pallet according to claim 5, wherein the second end of the first ramp comprises a first protruding portion and the second end of the second ramp comprises a second protruding portion, the first and second protruding portions being supported by the first and the second ramp supporting blocks respectively to stabilize the ramps during unloading of the equipment.

7. The pallet according to claim 6, wherein a first and a second strapping hole extend through the support plate in a direction perpendicular to the plane of the support plate, a third strapping hole extends through the first protruding portion and a fourth strapping hole extends through the second protruding portion.

8. The pallet according to claim 7, further comprising a first piece of strapping to be passed over the equipment during storage and transportation, through the first strapping hole, through the first access space, through a recessed groove in the central board, through the second access space, and through the second strapping hole.

9. The pallet according to claim 7, further comprising a second piece of strapping to be passed over the equipment during storage and transportation, through the third strapping hole and through the first access space, and a third piece of strapping to be passed over the equipment, through the fourth strapping hole and through the second access space.

10. A pallet for the storage, transportation and unloading of equipment, comprising:

(a) a support plate lying in a plane and having a front edge, a back edge, a first side edge and a second side edge;

(b) a supporting structure extending from the support plate for supporting the support plate above a support surface, the supporting structure defining an opening between the plane of the support plate and the supporting structure and extending at least partially through the supporting structure between the front and back edges of the support plate; and (c) a movable ramp having a first end and a second end, the ramp being movable between a storage position wherein the ramp is positioned within the opening while storing and transporting the equipment and a use position wherein the ramp extends outwardly from the front edge of the support plate for unloading the equipment.

11. The pallet according to claim 10, wherein the pallet further comprises..means for suspending the ramp within the opening, the suspending means connected to the support plate and creating an access space between the ramp and the support plate.

* * * * *